United States Patent [19]

Hean, Sr.

[11] Patent Number: 4,684,035

[45] Date of Patent: Aug. 4, 1987

[54] THEFT RESISTANT CABINET FOR COIN OPERATED EQUIPMENT

[76] Inventor: George J. Hean, Sr., Five Appletree Sq., Bloomington, Minn. 55420

[21] Appl. No.: 930,715

[22] Filed: Nov. 13, 1986

Related U.S. Application Data

[63] Continuation-in-part of Ser. No. 903,748, Sep. 5, 1986.

[51] Int. Cl.[4] ..... B65D 43/20

[52] U.S. Cl. ..... 220/346; 220/210

[58] Field of Search ..... 220/210, 18, 3.8, 345, 220/346; 49/463, 465, 466; 70/95; 312/138, 330

[56] References Cited

U.S. PATENT DOCUMENTS

| | | | |
|---|---|---|---|
| 3,856,177 | 12/1974 | Fudge | 220/346 |
| 4,135,375 | 1/1979 | Voegeli | 220/346 |
| 4,484,692 | 11/1984 | Palermo et al. | 220/346 |

*Primary Examiner*—George T. Hall

*Attorney, Agent, or Firm*—Kinney & Lange

[57] ABSTRACT

A cabinet has an access cover which is slidably mounted in heavy guide tracks extending longitudinally along the cabinet, and the cover has a locking flange that overlies one end wall of the cabinet when the cover is slid closed. The flange can be tightly drawn down to prevent pry bars and the like from being inserted to force the cover open. The flange is made so that it tightly engages a portion of the end wall against which it is drawn, and a protector ledge is provided adjacent the flange edge to prevent insertion of a pry tool.

15 Claims, 7 Drawing Figures

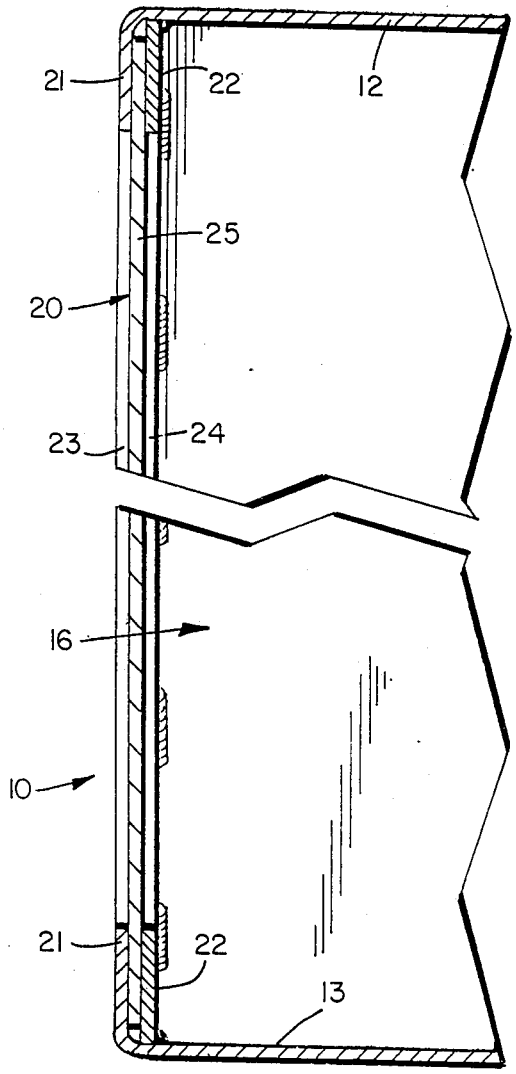
Fig. 4
Fig. 5
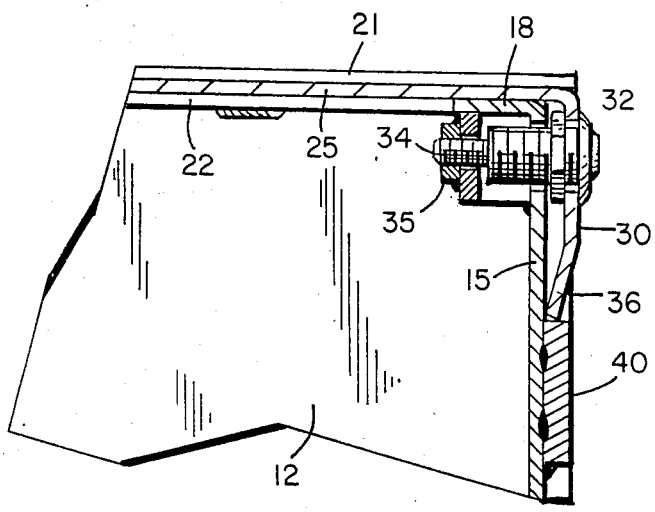

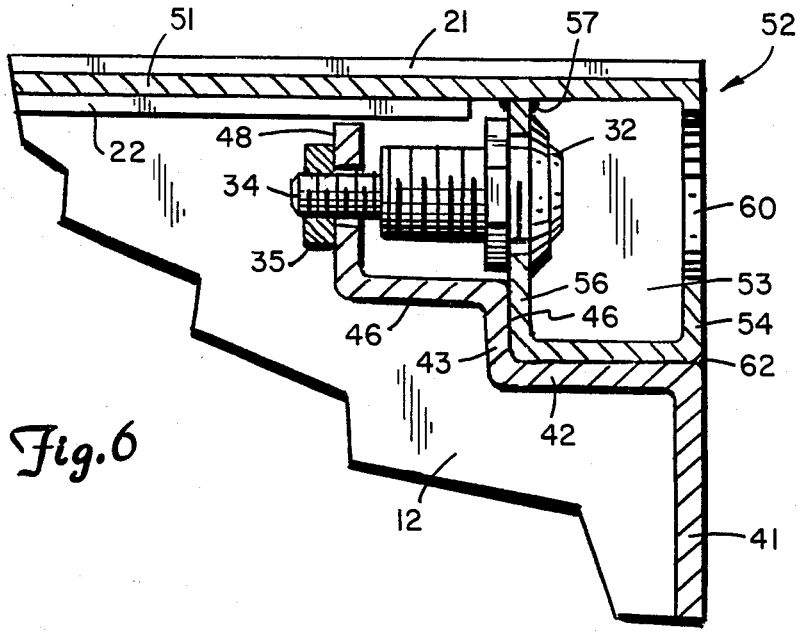
Fig. 6
Fig. 7
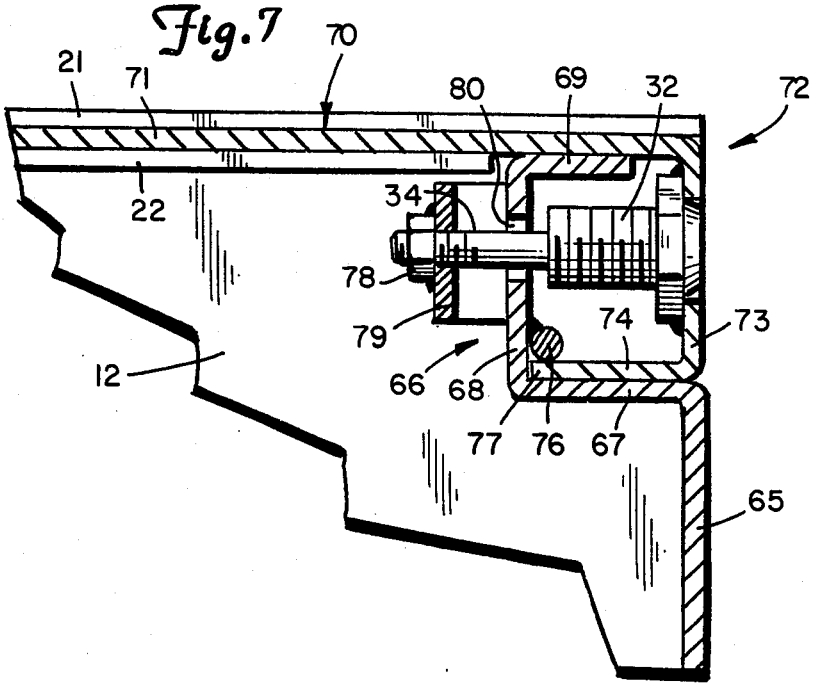

THEFT RESISTANT CABINET FOR COIN OPERATED EQUIPMENT

CROSS-REFERENCE TO RELATED APPLICATION

This Application is a continuation-in-part of my copending application Ser. No. 903,748, filed Sept. 5, 1986 for "Theft Resistant Cabinet for Coin Operated Equipment."

BACKGROUND OF THE INVENTION

1. Field of the Invention

The present invention relates to theft resistant compartments or cabinets used for coin-operated equipment that is accessible to the public.

2. Description of the Prior Art

Prior art coin operated dispensers of air under pressure in service stations are mounted in cabinets that are on the exterior of buildings, generally, and therefore are easily accessible to the public. In off hours and the like, vandals tend to try to enter these compartments to steal, the money from the interior coin box. Thus, the compartment strength and theft resistance is of great concern. Devices sold under the trademark AIRVEND are typical application, and present compartment forms improvements over this type of device to make it more damage and theft resistant.

SUMMARY OF THE INVENTION

The present invention relates to a cabinet that has a sliding access door held within sliding channels, and which moves longitudinally along the front side of the cabinet to enclose it. The leading edge of the sliding doors also is received in a channel or guide at one end of the compartment to receive the leading edge of the sliding cover as it is moved closed. The second end is bent over to form a flange that bears against the opposite end wall of the compartment and which can be drawn tightly down against the second end wall through a key actuated drawbolt. The edge of the flange is bent to form a lip which tightly engages the surface of the end wall, and, as shown, a further protective bar is welded to the end wall permanently in place and is closely adjacent the lip on the flange so that a pry bar cannot be inserted under the flange lip to tend to pry it open. The sliding track for the cover tightly fits the cover, and is sturdy to prevent prying and damaging the cover and unit.

Sufficiently heavy stainless steel walls are utilized to insure rigidity and resistance to bending.

The cabinet is made so that it can be opened for servicing of equipment on the interior, generally for coin operated use, such as air compressors and motors, controls used with such compressors and motors, and coin boxes for receipts.

The cabinet is made so that it would normally be mounted on the exterior of a building for normal use, and because of this access to the public the need for a high strength, damage resistant cabinet is present.

BRIEF DESCRIPTION OF THE DRAWINGS

FIG. 4 is a sectional view taken on line 4—4 in FIG. 1;

FIG. 5 is a sectional view taken on line 5—5 in FIG. 1;

FIG. 6 is a sectional view taken substantially on the same line as FIG. 5, showing a modified form of the theft prevention arrangement of the present invention; and FIG. 7 is a sectional view on substantially the same line as FIG. 5 showing a further modified form of the theft invention arrangement of the present invention.

DETAILED DESCRIPTION OF THE PREFERRED EMBODIMENTS

Figure 1:
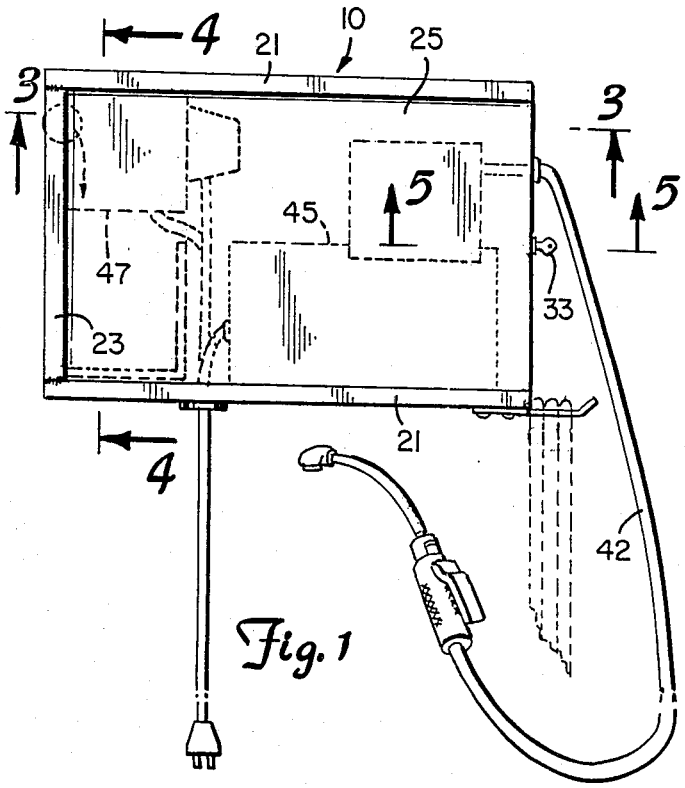
FIG. 1 is a front elevational view of a compartment made according to the present invention.
Figure 2:
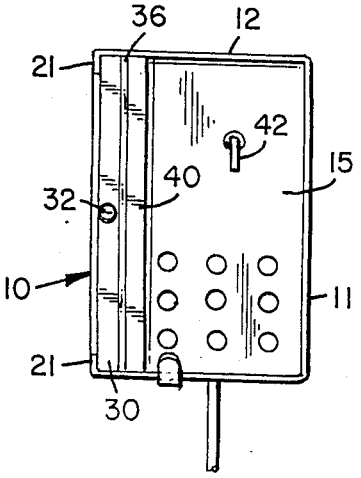
FIG. 2 is an end view of FIG. 1.

A theft resistant department or cabinet indicated generally at 10 is provided with a heavy-duty wall construction including a base wall 11, top and bottom walls (when oriented as shown) 12 and 13, respectively, and end walls 14 and 15, respectively which form a complete enclosure having and interior compartment or chamber 16. The construction is made of heavy guage stainless steel as shown, and the top and bottom walls and base wall are all formed in a single piece of material, with suitable bends at the corners or junctions, and then the end panels 14 and 15 are welded in place to securely make the assembly. Note that the panels end walls 14 and 15 are within the periphery of the cabinet. This permits the end wall to be welded in place securely on the interior of the compartment 16.

The upper and lower wall 12 and 13 each are provided with suitable tracks indicated generally at 20. The tracks include an upper track guide 21, and a lower track guide 22, which are at the outer edges of the top and bottom walls 12 and 13, respectively. The track guide 21 is formed by bending edges of the walls 12 and 13 and guide 22 are welded in place. The end wall 14 has track guides comprising a bent over lip 23 and a flange 24 welded in place to form a receptacle to receive the first end edge portion of the sliding cover 25.

The interior compartment 16 is closed with a sliding door or cover indicated at 25. The cover 25 fits within the track guides 21 and 22 as shown, and slides longitudinally along so that when it covers the compartment 16, the end edge portion 26 of the cover 25 is received between the track guides 23 and 24 on wall 14. The wall 15 has a bent over lip 18 positioned at a first level below the tracks so the cover can pass over the lip 18 of wall 15 as shown in FIG. 5. The lip 18 supports the cover 25, as well. The opposite or second end of the cover 25 from the edge 26 is bent over into a locking flange 30, which carries a key tumbler assembly indicated generally at 32. The key tumbler assembly is of the type that has a key 33 that can be inserted to rotate the tumbler, and when rotating, the key will continuously rotate a screw-threaded fastener 34 (FIG. 5) that is in position to engage and be threaded into a locking, draw nut 35. The threaded fastener 34 comprises, therefore, a drawbolt which is threaded into the nut 35 and rotated with the key 33 in the lock so that the drawbolt 34 will force the cover 25 tightly into position with the flange 30 and bent over edge lip 36 of flange 30 against the end wall 15 to tightly lock the sliding cover 25 in position.

The nut 35 is securely fixed in brackets to the side walls and end walls.

Figure 3:
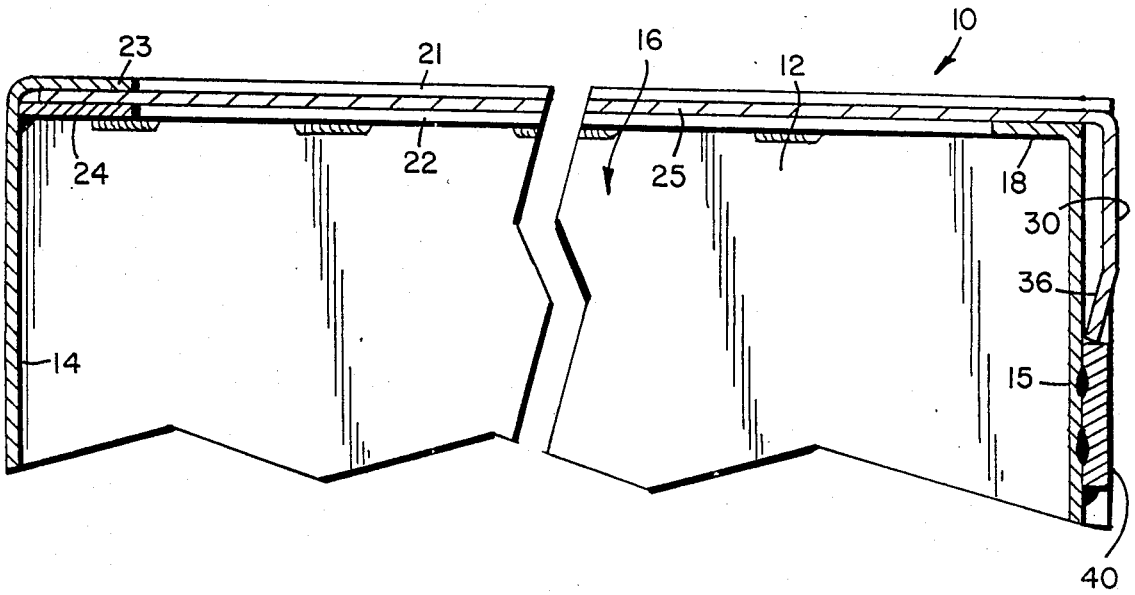
FIG. 3 is a fragmented sectional view taken on Line 3—3 in FIG. 1.

Once the key 33 is removed, the lock and drawbolt 34 cannot be rotated. Thus, the threaded drawbolt 34 will hold the cover tightly in place with the end portion 26 in the receptacle 23 and the lip 36 tightly held against the surface of the end wall Additional "anti-pry" features are provided to discourage prying of the cover to attempt to break the lock or to bend the door open. In the first form of the invention, an additional anti-pry rib 40 is welded to the exterior of the end wall 15, as shown in FIGS. 3 and 5 so that it is positioned to just clear the lip 36 of the flange 30. The lip 36 will slide past the upper surface of the rib 40 to permit the cover 25 to close. The rib 40 has sufficient depth so that it extends outwardly at least as far, and preferably slightly farther than, the outer surface of the flange 30 to prevent a pry bar from being inserted under the lip 36 for prying the cover open and gaining entry into the interior compartment 16.

The end wall 15 as shown has an opening for permitting an air hose 42 to protrude, and as shown in FIG. 1 the air hose can be hung on a suitable hanger underneath the cabinet 10. A suitable electrical outlet is used for powering the components including an air compressor 45, through suitable relays and controls indicated only generally at 46. Coin operated mechanisms are provided for actuating a timer 47 so that the compressor will run for a selected length of time when the coins are deposited and will provide for air under pressure through the hose 42. Openings also are provided in wall 15 for make-up air entry for the compressor.

Thus, the cabinet 10 is specifically designed for securely holding coin operated devices.

The cabinet 10 is of simplified construction but yet has substantial resistance to tampering, and in particular as shown in the first form of the invention with the rib or bar 40 adjacent the lip 36 on the locking flange 30, and with the ability to draw tightly the locking flange 30 against the end wall surface so that the ability to force pry bars under section or edge of the cover is reduced substantially, security is achieved.

The track guides are heavy and form full length slots to support and hold the sliding cover 25. Prying the cover is discouraged because a snug sliding fit on the cover is provided. The cabinet is of heavy gauge (about 1/16" thick) stainless steel so it does not bend easily. The track guides overlap the edges of the sliding cover a significant amount to provide support. The inner end edge of the cover is also fully supported in track guides 23 and 24 so the entire periphery of the cover 25 is retained against pry bar damage. The end of the cover 25 adjacent wall 15 is supported by lip 18.

In FIG. 6, a modified form of the invention is shown, in relation to providing anti-pry features to the exposed end of the cover and also for making the lock less accessible. The cabinet is constructed in substantially the same way as before. In the modified form shown in FIG. 6, the end wall shown at 41, which corresponds in position to the wall 15, is fixed to the side wall 12, and has an end portion adjacent the opening to the compartment that is recessed by bending it in a stepped configuration in cross-section that provides anti-pry security. As shown, the end wall 41 has a first ledge or step 42 that extends inwardly toward the interior of the chamber. The side wall 41 and formed ledge 42 extend across the cabinet between the side walls of the cabinet 10. The ledge 42 extends inwardly a desired amount, and a step leg 43 is bent at right angles to the ledge 42 and parallel to the main portion of the end wall 41. Leg 43 extends toward the track in the cabinet to provide a stop shoulder surface 44. The leg 43 in turn is joined to a second step or ledge 46 that is parallel to the ledge 42, and which in turn has a second leg 48 joined thereto. Leg 48 is parallel to leg 43 and to the plane of the main portion of end wall 41. The leg 48 is spaced inwardly to the interior of the cabinet a substantial distance, and farther than leg 43. The steps or ledges can be integrally formed from the same sheet of material as the main portion of wall 41, or the recessed walls can be welded in place.

In this form of the invention, the track guides supporting the cover are the same, as shown at 21, and 22, except the track guides 22 are changed in length to provide for necessary clearance. The cover 52 in this form of the invention comprises a flat plate 51 that slides between the tracks or guides 21 and 22 as previously described. At the outer end of the cover; that is, the end which slides in and out first, the cover is bent over into a substantially rectangular cross-section, box-like flange indicated generally at 53. The flange 53 overlaps the recessed steps which form a part of wall 41 and thus overlaps the end wall, as does flange 30. The flange 53 is a box section and thus very rigid, and includes an outer wall portion 54, a base wall 55 that overlies the ledge 42, and a lock support wall 56 which is parallel to the wall section 54. The lock support wall 56 can be welded in place against the flat portion of the cover with a suitable weld 57 so that the flat portion 51 and the wall section 56 are welded together to form a rigid box section.

The lock assembly 32, which is the same as that shown in the previous form of the invention, is fastened in the wall section 56, and an opening 60 is provided through the outer wall section 54 for key access. The opening 60 aligns with the lock assembly, and permits the insertion of a key that is used for turning the screw threaded member 34 into a nut 35 which in turn is welded on to the leg 48, which is formed as part of the wall 41.

It can thus be seen that a formed flange on the end of the cover overlaps a portion of the end wall and a wall section (leg 42) extends out as far as the flange (overlaps the edge of the flange) to prevent a pry bar from being easily inserted to pry the cover open. The flange 53 in this form also is a box section that reinforces the cover. The flange 53 can be tightly drawn down against the leg 43, which is integral with the end wall 41. This leaves virtually no space in which to insert a pry bar in the gap indicated at 62 where the cover joins the side wall 41. The overlap arrangement for the exposed edge or flange 53 serves the same purpose as the rib or bar 40. The second form of the flange is more rigid, and provides the anti-pry feature with one piece construction. The lock is coupled back to the end wall. The need for adding a separate piece for holding the nut 35 in place for the lock assembly is also eliminated.

The opening 60 is only large enough to permit the key to be passed through, and thus does not provide an opening for easy access to pound on or try to pick the lock. Opening 60 is a circular opening aligning with the lock 32.

The box construction formed by the wall sections 54, 55 and 56, together with the junction with the top cover plate 51 provides a very strong, unbendable end flange to increase the strength and rigidity of the cover member and prevent jimmying with pry bars or the like.

FIG. 7 shows a further modified form of the invention which provides a cover that inhibits and prevents prying for opening. In the form of the invention shown in FIG. 7, an end wall 65 of the cabinet, as shown, is bent to have a substantially channel shaped end adjacent the chamber opening as indicated generally at 66. The channel shaped end comprises a first ledge or step 67 that is bent inwardly from the plane of the wall 65, an upright leg 68, and then a bent over wall 69 that is bent back toward the plane of the main part of the wall 65, or toward the outside of the cabinet. This then forms an inset that is a single step inset with a general U shape. The leg 69 provides a guide for a cover indicated generally at 70 that has a flat plate portion 71 riding between track guides 21 and 22 that are fixed to the side wall 12.

Cover member 70 has a generally U-shaped channel end section indicated generally at 72, which includes a vertical wall flange portion 73 which, when the cover is closed, aligns with the end wall 65, and an inwardly bent leg or lip 74 that rests on top of and mates with the leg 67 of the end wall. When the cover is in closed position as shown in FIG. 7, the leg 74 interfits with the legs 67 and 69.

In order to prevent the edge of the flange wall 73 from being pried and bent upwardly, and thus to enhance the theft prevention features, a lock bar 76 is welded to the leg 68 and extends for the full length of the end wall 65 to provide a positive stop for preventing the outer end lip 77 of the cover edge lip 74 from being bent upwardly and thus prevents the flange from being bent upwardly.

The cover 70 is locked in place with a lock assembly 32 as previously shown, but in this case the lock assembly 32 is welded to the end wall flange 73 in a suitable manner. The flange 73 could have studs or bolts welded to its inner surface and then used to hold the lock assembly in place. The lock assembly 32 has threaded bolt 34 that is adapted to thread into a nut 78 which is mounted onto a bracket 79 that in turn is fixed to the leg 68, and is spaced slightly therefrom to provide the proper positioning so that the lock can be turned to thread the bolt down tightly and draw the cover tightly closed.

The leg 68 has an opening 80 through which the bolt 34 passes, and also the bracket 79 has an opening for the bolt 34 so that it can reach the nut 78. The nut 78 can be held in place with a suitable fastener, or welded in place as shown. The opening for the lock assembly 32 is right in the cover flange 73. In this form of the invention, there is a flange on the cover that overlaps the adjacent end of a cabinet wall with a ledge that protects the edge of the flange. As shown, the edge flange 74 rests on top of the protection edge 67 when the cover is drawn closed. In the arrangement shown in FIG. 6, prying of the cover flange relative to the step of the end wall is prevented by having the cover made into a box section. In the embodiment of FIG. 7, the anti-pry detent or rod 76 prevents prying of the cover to get it open or to jimmy it.

Further, the top leg 69 of the end wall supports the cover securely, so that any prying tending to lift the flange and edge flange 74 will be reacted by the flange 69 acting through the leg 68. Security again is assured with this construction, and the construction is simplified over that shown in FIG. 6. The end wall is easier to form as a unit, and the rib or stop rod 76 can be easily welded in place to prevent the outer lip portion 77 of the ledge 74 from being bent upwardly.

Although the present invention has been described with reference to preferred embodiments, workers skilled in the art will recognize that changes may be made in form and detail without departing from the spirit and scope of the invention.

What is claimed:

1. A cabinet construction for resisting forceable entry comprising:

a base wall, first and second side walls extending generally perpendicularly from the base wall, and first and second end walls at the ends of said base wall and the first and second side walls and being fixedly secured to the base walls, and the first and second side walls;

track guide means along the edges of the first and second side walls and the first and wall at edges opposite from the base walls, the second end wall being formed to permit access from the second end to open ends of the track guide means;

a cover havng a main portion slidably interfitted with and mounted for movement with respect to said track guide means, and having a first edge portion that is adapted to be slidably interfitted with the track guide means on the first end wall, said cover having a cover wall flange bent at substantially right angles to the main portion which extends to overlap a portion of the second end wall adjacent the track guide means when the cover is closed, said flange resting against a portion of said second end wall when the cover is closed with the first edge portion of the cover interfittingly supported on the track guide means on the first end wall; and means for lockably drawing the cover to a position with portions of said second end wall and flange in engagement.

2. The apparatus specified in claim 1 wherein the second wall member is substantially planar and the first cover wall flange engages the outer surface of the second end wall, a rib fixed on such second end wall adjacent the flange of the cover, so that when the flange is drawn against the second end wall, the rib extends outwardly from the end wall substantially the same distance as the flange to prevent entry of a pry bar between the flange and the surface of the second end wall which it engages.

3. The apparatus as specified in claim 1 wherein said cover has an outer end portion that is adjacent said second side wall when the cover member is closed, said outer end portion being bent to form a flange having a plane substantially parallel to the main portion of said second end wall and a free edge, means on the end wall forming a ledge surface immediately adjacent the free edge of the flange to prevent prying against the free edge.

4. The apparatus of claim 3 wherein the means to form a ledge surface comprises a wall section bent from the plane of the end wall.

5. The apparatus of claim 4 and a leg portion projecting from the wall section forming the ledge and spaced inwardly from the main portion of said second end wall, whereby said lock means will force the flange of the cover to be positioned above the wall section forming the ledge on the end wall, and will urge the cover towards said leg.

6. The apparatus as specified in claim 3 wherein said cover flange is formed in a box cross-section and has a first wall section extending parallel to the ledge and a second wall section joining the first wall section and extending back toward the main portion of the main portion of the cover to form the box cross-section, the means for lockably drawing being mounted on said second wall section, and an access opening in said flange aligning with said means for lockably drawing.

7. The apparatus of claim 5 and a rib fixed on said leg portion of the end wall, said cover having a ledge joining the cover flange and overlying the ledge of the end wall, the ledge of the cover fitting under the rib when the cover is closed to prevent the ledge of the cover from being pried upwardly.

8. The apparatus as specified in claim 6 wherein said means for lockably drawing comprises a rotatable screw operable with a key, said screw fitting into a nut, and said nut being mounted on a portion of said end wall offset inwardly into the cabinet a sufficient distance to permit the rotatable screw to be mounted in said second wall section of said cover flange and to engage the nut mounted on said second end wall.

9. The cabinet construction of claim 1 wherein said second end wall has an upper portion that is of a stepped configuration, said step having first and second ledge portions and leg portions between the ledge portions, said ledge portions being generally parallel to the main part of said cover, said first ledge portion forming a first recess inwardly from the outer surface of the second end wall, said cover flange having a wall section bent parallel to said first ledge portion and which engages the leg joining the first ledge portion and second ledge portion of said second end wall when the cover is drawn tight.

10. The apparatus of claim 8 wherein said second ledge portion has a second leg positioned farther inwardly from the main portion of the end wall than the first leg, and said means for lockably drawing comprising a threadable bolt, said second leg of said stepped section having a nut mounted thereon adapted to receive a bolt of said means for lockably drawing, said means for lockably drawing being mounted on said cover and being adapted to exert force pulling the cover toward the first mentioned leg on the stepped portion of said second end wall.

11. The cabinet of claim 1 wherein said flange has a lip bent from the plane thereof extending toward the outer surface of the second end wall so that the lip at the outer edge of said flange engages the outer surface of said second end wall when the cover is drawn tight.

12. The cabinet as specified in claim 1 wherein said means for drawing said cover tight comprises a keylock tumbler mounted on the cover flange and having a draw bolt rotatable with a key in the tumbler, and a drawbolt nut fixedly mounted with respect to said cabinet to provide the drawbolt action to tighten the flange against the outer surface of said second end wall.

13. The cabinet as specified in claim 1 wherein said second end wall has a lip at the upper edge thereof extending inwardly to the interior compartment in position to support the cover.

14. A cabinet construction for resisting forceable entry comprising an enclosure formed of wall means defining at least one end wall and side walls, with an opening on one side, a cover for closing said opening guiding the cover, track means formed on the side walls, said one end wall having a portion adjacent said cover that is bent to form a ledge extending inwardly into said compartment, a leg that extends toward said opening, and a second ledge that extends back parallel to the first mentioned ledge and toward the main portion of said end wall;

said cover having an end section that overlies said second mentioned ledge of said end wall in closed position, and has a flange and a cover ledge that overlaps the portions of said end wall adjacent the opening, and said end wall having a rib that receives the outer edge portion of said flange, the first mentioned ledge of said end wall and said flange of said cover overlying each other and being held from substantial separation by said rib when said cover is closed.

15. The apparatus as specified in claim 14 and draw bolt means to pull said cover to a closed position.

* * * * *

UNITED STATES PATENT AND TRADEMARK OFFICE

CERTIFICATE OF CORRECTION

PATENT NO. : 4,684,035

DATED : August 4, 1987

INVENTOR(S) : George J. Hean, Sr.

It is certified that error appears in the above-identified patent and that said Letters Patent is hereby corrected as shown below:

Column 6, line 8, delete "walls" and insert --wall--.

Column 6, line 11, after "first", delete "and" and insert --end--.

Column 6, line 15, delete "havng" and insert --having--.

Signed and Sealed this

First Day of December, 1987

*Attest:*

DONALD J. QUIGG

*Attesting Officer*

*Commissioner of Patents and Trademarks*